US010229566B2

(12) United States Patent
Lee et al.

(10) Patent No.: US 10,229,566 B2
(45) Date of Patent: Mar. 12, 2019

(54) METHOD OF PROVIDING INFORMATION FOR SUPPORTING RESCUE IN DISASTER AREA AND APPARATUS THEREFOR

(71) Applicant: ELECTRONICS AND TELECOMMUNICATIONS RESEARCH INSTITUTE, Daejeon (KR)

(72) Inventors: Hye Sun Lee, Daejeon (KR); Myung Nam Bae, Daejeon (KR); Sang Gi Hong, Daejeon (KR); Hyo Chan Bang, Daejeon (KR); Kang Bok Lee, Daejeon (KR); Dong Beom Shin, Daejeon (KR); Sang Yeoun Lee, Daejeon (KR); Kyo Hoon Son, Daejeon (KR); Hoe Sung Yang, Daejeon (KR); Jin Chul Choi, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/818,881

(22) Filed: Nov. 21, 2017

(65) Prior Publication Data

US 2018/0165929 A1 Jun. 14, 2018

(30) Foreign Application Priority Data

Dec. 13, 2016 (KR) ..... 10-2016-0169137

(51) Int. Cl.
*G08B 7/06* (2006.01)
*G08B 21/02* (2006.01)
(Continued)

(52) U.S. Cl.
CPC ..... *G08B 7/066* (2013.01); *G08B 7/06* (2013.01); *G08B 21/02* (2013.01);
(Continued)

(58) Field of Classification Search
None
See application file for complete search history.

(56) References Cited

U.S. PATENT DOCUMENTS 5,036,462 A * 7/1991 Kaufman ..... A61J 7/0084 600/300
6,873,256 B2 * 3/2005 Lemelson ..... G08B 7/066 340/511

(Continued)

FOREIGN PATENT DOCUMENTS

KR 10-1422234 B 7/2014
KR 2016-0076755 A 7/2016

*Primary Examiner* — Fekadeselassie Girma
(74) *Attorney, Agent, or Firm* — LRK Patent Law Firm

(57) ABSTRACT

An operation method of a first apparatus for supporting disaster communications includes obtaining map information of a disaster area from a server; obtaining information on a location of the first apparatus, and obtaining environmental condition information of the first apparatus indicating a risk of an area to which the first apparatus belongs; obtaining information on a location and environmental condition information of a second apparatus located in the disaster area from the second apparatus; determining a disaster risk level indicating a risk level for each location in the disaster area based on the location and environmental condition information of the first apparatus and the location and environmental condition information of the second apparatus; and updating the map information by reflecting the disaster risk level.

17 Claims, 6 Drawing Sheets

(51) Int. Cl.
*G08B 21/04* (2006.01)
*G08B 21/12* (2006.01)
*G08B 27/00* (2006.01)

(52) U.S. Cl.
CPC ..... *G08B 21/0263* (2013.01); *G08B 21/04* (2013.01); *G08B 21/0453* (2013.01); *G08B 21/12* (2013.01); *G08B 27/00* (2013.01); *G08B 27/001* (2013.01)

(56) References Cited

U.S. PATENT DOCUMENTS

| | | | | |
|---|---|---|---|---|
| 8,786,425 | B1 * | 7/2014 | Hutz | H04M 11/04 340/526 |
| 9,860,839 | B2 * | 1/2018 | Kates | G08B 1/08 |
| 9,911,315 | B2 * | 3/2018 | P | G08B 27/006 |
| 2003/0234725 | A1 * | 12/2003 | Lemelson | G08B 7/066 340/521 |
| 2007/0241261 | A1 * | 10/2007 | Wendt | G01D 9/005 250/221 |
| 2008/0314681 | A1 * | 12/2008 | Patel | A62B 3/00 182/18 |
| 2012/0157121 | A1 | 6/2012 | Li et al. | |
| 2013/0016629 | A1 | 1/2013 | Mallik et al. | |
| 2013/0059614 | A1 * | 3/2013 | Kannan | H04W 72/06 455/500 |
| 2013/0089010 | A1 | 4/2013 | Richardson et al. | |
| 2014/0011471 | A1 | 1/2014 | Khosla et al. | |
| 2014/0319866 | A1 * | 10/2014 | Freitag | B60P 3/224 296/24.32 |
| 2014/0334338 | A1 | 11/2014 | Joo | |
| 2015/0308831 | A1 | 10/2015 | Lee et al. | |
| 2016/0198330 | A1 | 7/2016 | Chung et al. | |
| 2018/0055434 | A1 * | 3/2018 | Cheung | A01K 1/031 |
| 2018/0098283 | A1 * | 4/2018 | Kates | G08B 1/08 |

* cited by examiner

METHOD OF PROVIDING INFORMATION FOR SUPPORTING RESCUE IN DISASTER AREA AND APPARATUS THEREFOR

CROSS-REFERENCE TO RELATED APPLICATION

This application claims priority to Korean Patent Application No. 10-2016-0169137, filed Dec. 13, 2016 in the Korean Intellectual Property Office (KIPO), the entire content of which is hereby incorporated by reference.

BACKGROUND

1. Field of the Invention

The present disclosure relates to a method and an apparatus for providing information supporting rescues, and more specifically, to a method and an apparatus for providing information for supporting rescues in disaster circumstances.

2. Description of Related Art

Disaster communications may be referred to as communications carried out in order to protect lives and properties of people in the event of natural disasters such as typhoons, heavy rains and heavy snow, man-made disasters such as subway fires, collapse of large buildings, and emergencies such as terrorism and war.

When a disaster occurs, communication infrastructures (e.g., base stations, etc.) may be destroyed or power supply to the communication infrastructures may be blocked. In these eases, there arises a problem that information necessary for rescues cannot be transmitted to a terminal of a rescuer through the communication infrastructures (or, information related to the rescuer cannot be transmitted to a base station). Therefore, when a disaster occurs, a situation, in which information should be exchanged through direct communications between terminals without the base station, may occur.

Conventionally, there have been various studies related to the inter-terminal, communication technologies. However, there has been a problem in that there is a lack of studies regarding a method of effectively coping with a dangerous situation and safely evacuating to a safe area through direct communications between terminals of rescuers.

SUMMARY

Accordingly, embodiments of the present disclosure provide a method for enabling communications between rescuers even in an environment without infrastructure.

In order to achieve the objective of the present disclosure, an operation method of a first apparatus for supporting disaster communications may comprise obtaining map information of a disaster area from a server; obtaining information on a location of the first apparatus through a first sensor included in the first apparatus when the first apparatus is located in the disaster area, and obtaining environmental condition information of the first apparatus indicating a risk of an area to which the first apparatus belongs through a second sensor included in the first apparatus; obtaining information on a location and environmental condition information of a second apparatus located in the disaster area from the second apparatus; determining a disaster risk level indicating a risk level for each location in the disaster area, based on the location and environmental condition information of the first apparatus and the location and environmental condition information of the second apparatus; and updating the map information by reflecting the disaster risk level.

The determining a disaster risk level may comprise classifying environmental condition information for the respective locations of the first apparatus and the second apparatus according to a predetermined criterion; and determining the disaster risk level corresponding to the classified environmental condition information for the respective locations of the first apparatus and the second apparatus.

The operation method may further comprise determining whether a current situation is a situation requiring departure from the disaster area; in response to determination that the current situation is the situation requiring departure from the disaster area, classifying at least one location whose disaster risk level is higher than a predetermined threshold based on the map information reflecting the disaster risk level; identifying an optimal return path avoiding the at least one location whose disaster risk level is higher than the predetermined threshold based on the location of the first apparatus; and displaying the optimal return path on a display device included in the first apparatus.

The operation method may further comprise, when the first apparatus is out of the disaster area, transmitting, to the server, rescue operation history information including movement path information of the first apparatus, the environmental condition information for respective locations of the first apparatus, movement path information of the second apparatus, and the environmental condition information for respective locations of the second apparatus.

The movement path information of the first apparatus may be generated based on the location of the first apparatus, and the movement path information of the second apparatus may be generated based on the location of the second apparatus.

The operation method may further comprise updating the map information so that the map information indicate a location of each user through the location of the first apparatus and the location of the second apparatus; and displaying the updated map information on a display device included in the first apparatus.

The environmental condition information of the first apparatus may include ambient temperature, composition of ambient air, and presence of an obstacle at the location of the first apparatus, and the environmental condition information of the second apparatus may include ambient temperature, composition of ambient air, and presence of an obstacle at the location of the second apparatus.

The operation method may further comprise obtaining first physical condition information of a first user through a third sensor included in the first apparatus; obtaining second physical condition information of a second user from the second apparatus; and displaying the first physical condition information and the second physical condition information on a display device included in the first apparatus.

The operation method may further comprise generating an alert signal for the first apparatus when the environmental condition information of the first apparatus exceeds a predetermined reference value; and transmitting the alert signal in a broadcast manner.

In order to achieve the objective of the present disclosure, a first apparatus for supporting disaster communications may comprise a processor and a memory at least one instruction executed by the processor. Also, the at least one instruction may be configured to obtain map information of a disaster area from a server; obtain information on a location of the first apparatus through a first sensor included in the first apparatus when the first apparatus is located in the disaster area, and obtain environmental condition information of the first apparatus indicating a risk of an area to which the first apparatus belongs through a second sensor included in the first apparatus; obtain information on a location and environmental condition information of a second apparatus located in the disaster area from the second apparatus; determine a disaster risk level indicating a risk level for each location in the disaster area based on the location and environmental condition information of the first apparatus and the location and environmental condition information of the second apparatus; and update the map information by reflecting the disaster risk level.

In the determining of the disaster risk level, the at least one instruction may be further configured to classify environmental condition information for the respective locations of the first apparatus and the second apparatus according to a predetermined criterion; and determine the disaster risk level corresponding to the classified environmental condition information for the respective locations of the first apparatus and the second apparatus.

The at least one instruction may be further configured to determine whether a current situation is a situation requiring departure from the disaster area; in response to determination that the current situation is the situation requiring departure from the disaster area, classify at least one location whose disaster risk level is higher than a predetermined threshold based on the map information reflecting the disaster risk level; identify an optimal return path avoiding the at least one location whose disaster risk level is higher than the predetermined threshold based on the location of the first apparatus; and display the optimal return path on a display device included in the first apparatus.

The at least one instruction may be further configured to, when the first apparatus is out of the disaster area, transmit, to the server, rescue operation history information including movement path information of the first apparatus, the environmental condition information for respective locations of the first apparatus, movement path information of the second apparatus, and the environmental condition information for respective locations of the second apparatus.

The movement path information of the first apparatus may be generated based on the location of the first apparatus, and the movement path information of the second apparatus may be generated based on the location of the second apparatus.

The at least one instruction may be further configured to update the map information so that the map information indicate a location of each user through the location of the first apparatus and the location of the second apparatus, and display the updated map information on a display device included in the first apparatus.

The environmental condition information of the first apparatus may include ambient temperature, composition of ambient air, and presence of an obstacle at the location of the first apparatus, and the environmental condition information of the second apparatus may include ambient temperature, composition of ambient air, and presence of an obstacle at the location of the second apparatus.

The at least one instruction may be further configured to obtain first physical condition information of a first user through a third sensor included in the first apparatus; obtain second physical condition information of a second user from the second apparatus; and display the first physical condition information and the second physical condition information on a display device included in the first apparatus.

The at least one instruction may be further configured to generate an alert signal for the first apparatus when the environmental condition information of the first apparatus exceeds a predetermined reference value; and transmit the alert signal in a broadcast manner.

According to the present disclosure, it is made possible to share physical condition information and environmental condition information between rescuers, and based on the information, it is made possible to effectively cope with the risk among rescuers. Also, an optimal return path can be identified based on the locations of the rescuers, the physical condition information, and the environmental condition information. Also, it is possible to database the rescue operation history information of the rescue workers, and it is possible to facilitate the analysis of the rescue workers after returning.

BRIEF DESCRIPTION OF DRAWINGS

Embodiments of the present disclosure will become more apparent by describing in detail embodiments of the present disclosure with reference to the accompanying drawings, in which.

DETAILED DESCRIPTION

Figure 1:
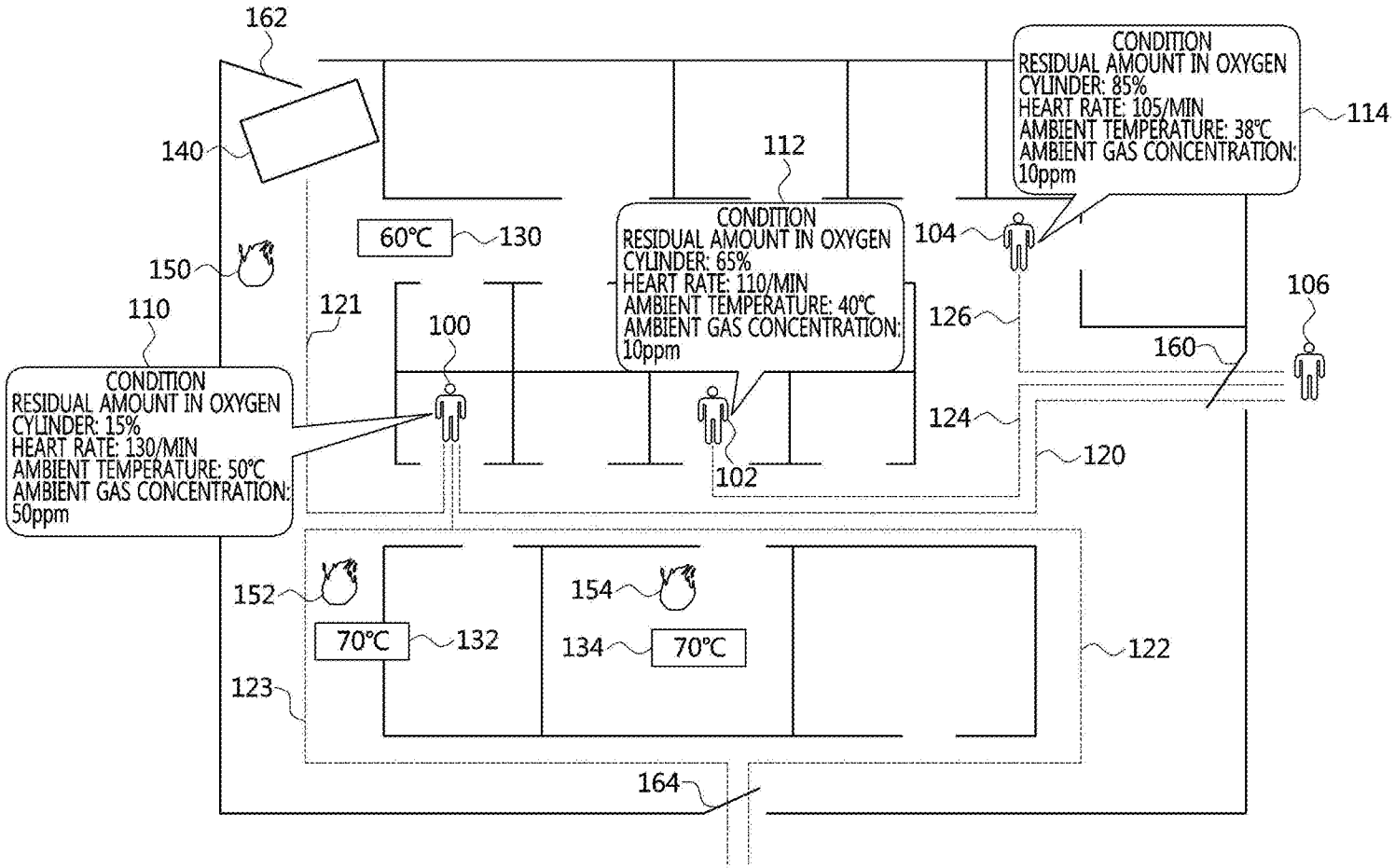
FIG. 1 is a conceptual diagram illustrating a disaster area.

Embodiments of the present disclosure are disclosed herein. However, specific structural and functional details disclosed herein are merely representative for purposes of describing embodiments of the present disclosure, however, embodiments of the present disclosure may be embodied in many alternate forms and should not be construed as limited to embodiments of the present disclosure set forth herein.

Accordingly, while the present disclosure is susceptible to various modifications and alternative forms, specific embodiments thereof are shown by way of example in the drawings and will herein be described in detail. It should be understood, however, that there is no intent to limit the present disclosure to the particular forms disclosed, but on the contrary, the present disclosure is to cover all modifications, equivalents, and alternatives falling within the spirit and scope of the present disclosure. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," etc.).

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present disclosure will be described in greater detail with reference to the accompanying drawings. In order to facilitate general understanding in describing the present disclosure, the same components in the drawings are denoted with the same reference signs, and repeated description thereof will be omitted.

Hereinafter, wireless communication networks to which exemplary embodiments according to the present disclosure will be described. However, wireless communication networks to which exemplary embodiments according to the present disclosure are applied are not restricted to what will be described below. That is, exemplary embodiments according to the present disclosure may be applied to various wireless communication networks.

FIG. 1 is a conceptual diagram illustrating a disaster area.

Referring to FIG. 1, information exchange between a plurality of users 100, 102, 104, and 106 may be required for efficient rescue. The information that needs to be exchanged may include various information on a risk of each of the plurality of users 100, 102, 104, and 106 (e.g., residual amount in oxygen cylinder, heart rate, ambient temperature, or ambient gas concentration of each user) and information on a location of each of the plurality of users 100, 102, 104, and 106.

The plurality of users 100, 102, 104 and 106 may easily identify the situation of the disaster area by identifying where a dangerous location is via such the information exchange, and identifying physical conditions of the plurality of users 100, 102, 104 and 106. Also, the plurality of users 100, 102, 104, and 106 may obtain optimal return paths excluding risk factors.

Information to be exchanged between the plurality of users 100, 102, 104, and 106 may be transmitted and received through a communication infrastructure outside the disaster area. However, power transmission and reception devices may be destroyed in the disaster area due to a collapse of a building, fire, earthquake, explosion, etc., and the communication infrastructure may be damaged due to the power interruption. Also, a base station, a gateway, an access point (AP), a server, and the like may be destroyed due to a collapse of a building, a fire, an earthquake, an explosion, or the like, and the communication infrastructure may be damaged.

In case of a disaster area without a communication infrastructure, communications between the plurality of users 100, 102, 104, and 106 may be performed using communication methods such as device-to-device (D2D) communications, pear-to-pear (P2P) communications, sub-GHz, ad-hoc WiFi, etc. In the following, detail rescue supporting methods using D2D communications will be described.

Figure 2:
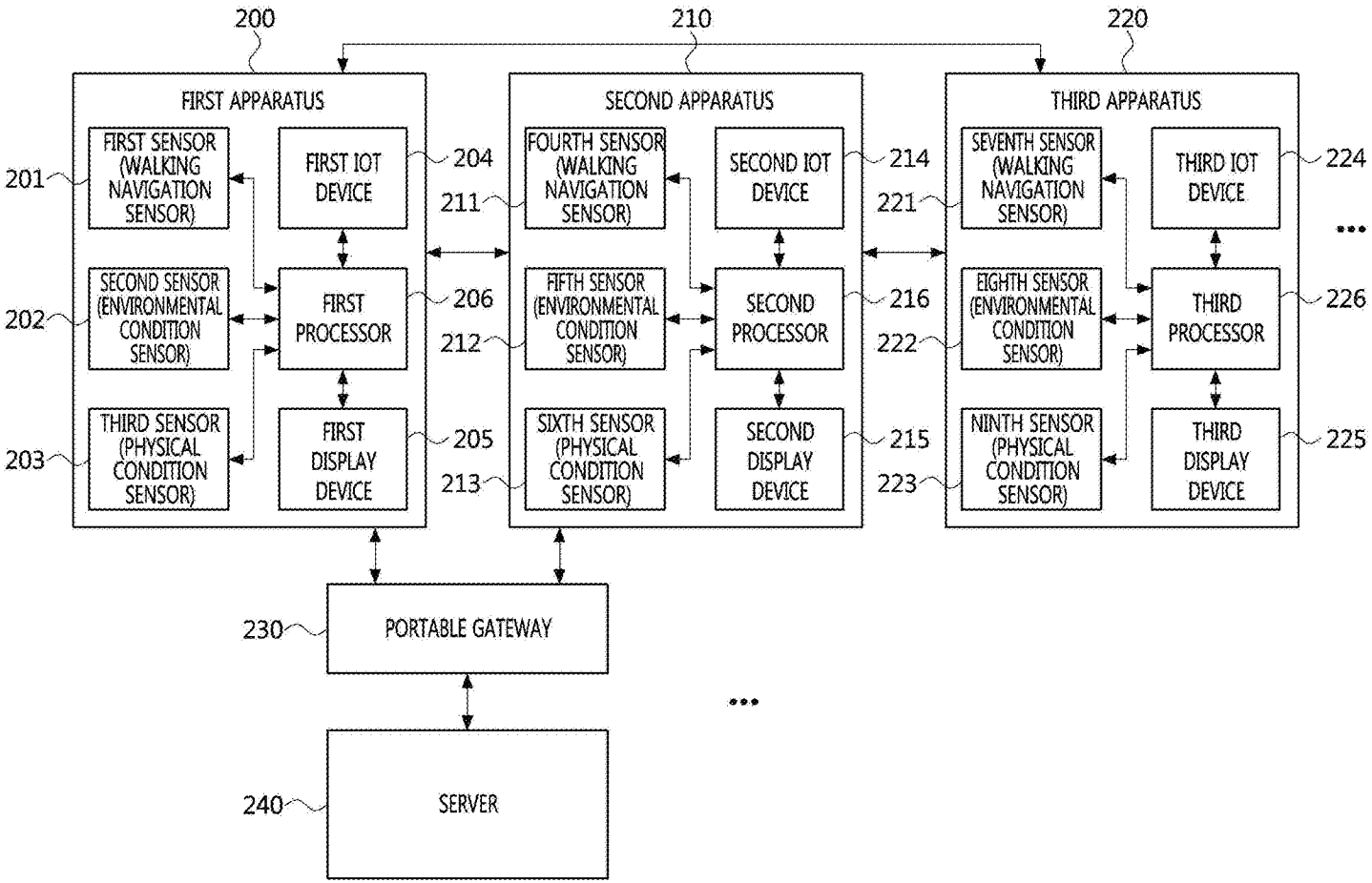
FIG. 2 is a block diagram illustrating a structure of a wireless communication network.

FIG. 2 is a block diagram illustrating a structure of a wireless communication network.

Referring to FIG. 2, relationship between rescue apparatuses to support rescues in a disaster area may be shown. The first user 100, the second user 102, and the third user 104 of FIG. 1 may respectively use a first apparatus 200, a second apparatus 210, and a third apparatus 220.

The first apparatus 200 may include a walking navigation sensor 201 (hereinafter, referred to as a 'first sensor'), an environmental condition sensor 202 (hereinafter, referred to as a 'second sensor'), a physical condition sensor 203, (hereinafter, referred to as a 'third sensor'), a first internet of thing (IoT) device 204, a first display device 205, and a first processor 206.

The second apparatus 210 may include a walking navigation sensor 211 (hereinafter, referred to as a 'fourth sensor'), an environmental condition sensor 212 (hereinafter, referred to as a 'fifth sensor'), a physical condition sensor 213, (hereinafter, referred to as a 'sixth sensor'), a second IoT device 214, a second display device 215, and a second processor 216.

The third apparatus 220 may include a walking navigation sensor 221 (hereinafter, referred to as a 'seventh sensor'), an environmental condition sensor 222 (hereinafter, referred to as an 'eighth sensor'), a physical condition sensor 223, (hereinafter, referred to as a 'ninth sensor'), a third IoT device 224, a third display device 225, and a third processor 226.

A transceiver included in the first apparatus 200 and a transceiver included in the second apparatus 210 may perform communications without an infrastructure in the disaster environment. Also, the transceiver included in the first apparatus 200 and a transceiver included in the third apparatus 220 may perform communications without an infrastructure in the disaster environment. Also, the transceiver included in the second apparatus 210 and the transceiver included in the third apparatus 220 may perform communications without an infrastructure in the disaster area. Communications between the plurality of apparatuses 200, 210, and 220 may be performed using communication methods such as D2D communications, P2P communications, sub-GHz, ad-hoc WiFi, etc.

The first apparatus 200 may communicate with a server 240 via a portable gateway 230. The portable gateway 230 may be referred to as a laptop computer, a tablet personal computer (PC), a wireless phone, a mobile phone, a smart phone, a smart watch, or the like. The server 240 herein may be referred to as a control server, a network server, a controller, or the like.

The location of the first user 100 may be measured by the first sensor 201 included in the first apparatus 200 of the first user 100. The environmental condition information of the first apparatus 200 may be measured by the second sensor 202 included in the first apparatus 200. The environmental condition information may include ambient temperature, ambient gas concentration, presence of surrounding obstacles, and the like.

The physical condition of the first user 100 may be measured by the third sensor 203 included in the first apparatus 200. The physical condition information may include heart rate information and body temperature information. The residual amount of an oxygen cylinder included in the first apparatus 200, the remaining battery amount of the battery included in the first apparatus 200, and the like may be measured by the first IoT device 204 included in the first apparatus 200.

The first display device 205 included in the first apparatus 200 may visually display, to the first user 100, the information obtained through the plurality of sensors 201, 202, and 203 of the first apparatus 200 and the first IoT device 204.

A first speaker 207 included in the first apparatus 200 may audibly provide, to the first user 100, information acquired through the plurality of sensors 201, 202, and 203 of the first apparatus 200 and the first IoT device 204.

The location of the second user 102 may be measured by the fourth sensor 211 included in the second apparatus 210 of the second user 102. The environmental condition information of the second apparatus 210 may be measured by the fifth sensor 212 included in the second apparatus 210.

The physical condition of the second user 102 may be measured by the sixth sensor 213 included in the second apparatus 210. The residual amount of an oxygen cylinder included in the second apparatus 210, the remaining battery amount of the battery included in the second apparatus 210, and the like may be measured by the second IoT device 214 included in the second apparatus 210.

The second display device 215 included in the second apparatus 210 may visually display, to the second user 102, the information obtained through the plurality of sensors 211, 212, and 213 of the second apparatus 210 and the second IoT device 214.

A second speaker included in the second apparatus 210 may audibly provide, to the second user 102, information acquired through the plurality of sensors 211, 212, and 213 of the second apparatus 210 and the second IoT device 214.

The location of the third user 104 may be measured by the seventh sensor 221 included in the third apparatus 220 of the third user 104. The environmental condition information of the third apparatus 220 may be measured by the eighth sensor 222 included in the third apparatus 220.

The physical condition of the third user 104 may be measured by the ninth sensor 223 included in the third apparatus 220. The residual amount of an oxygen cylinder included in the third apparatus 220, the remaining battery amount of the battery included in the third apparatus 220, and the like may be measured by the third IoT device 224 included in the third apparatus 220.

The third display device 225 included in the third apparatus 220 may visually display, to the third user 104, the information obtained through the plurality of sensors 221, 222, and 223 of the third apparatus 220 and the third IoT device 224.

A third speaker included in the third apparatus 220 may audibly provide, to the third user 104, information acquired through the plurality of sensors 221, 222, and 223 of the third apparatus 220 and the third IoT device 224.

Also, a N-th apparatus may include sensors, IoT devices, and display devices similar to those of the plurality of apparatuses 200, 210, and 220. Also, the N-th apparatus may have a similar function to the plurality of apparatuses 200, 210, and 220. The N-th apparatus may also perform inter-device communications without an infrastructure in a disaster area.

Figure 3:
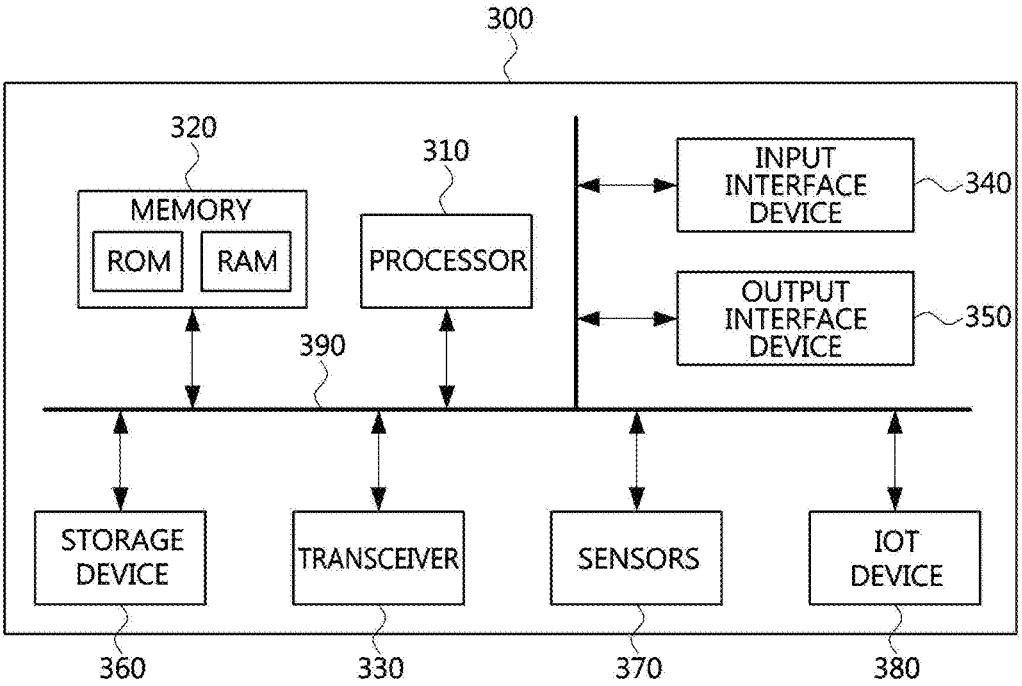
FIG. 3 is a block diagram illustrating an embodiment of a communication node constituting a wireless communication network.

FIG. 3 is a block diagram illustrating an embodiment of a communication node constituting a wireless communication network.

Referring to FIG. 3, a node 300 may include at least one processor 310, a memory 320, and a transceiver 330 connected to and performing communications with a server. Also, the node 300 may further include an input interface device 340, an output interface device 350, a storage device 360, a plurality of sensors 370, an IoT device 380, and the like. Each of the components included in the node 300 may be connected by a bus 390 to communicate with each other.

The processor 310 may correspond to the first processor 206, the second processor 216, the third processor 226, etc. of FIG. 2. The output interface device 350 may correspond to the first display device 205, the second display device 215, and the third display device 225 of FIG. 2, the first speaker 207 of FIG. 4, and the like.

The plurality of sensors 370 may correspond to the sensors 201, 211, and 221, the sensors 202, 212, and 222, and the sensors 203, 213, and 223 of FIG. 2. The IoT device 380 may correspond to the first IoT device 204, the second IoT device 214, and the third IoT device 224 of FIG. 2.

The processor 310 may execute at least one instruction stored in the memory 320 and/or the storage device 360. The processor 310 may be a central processing unit (CPU), a graphics processing unit (GPU), or a dedicated processor on which the methods of the present disclosure are performed. The memory 320 and the storage device 360 may be composed of a volatile storage medium and/or a non-volatile storage medium. For example, the memory 320 may be comprised of read only memory (ROM) and/or random access memory (RAM).

Embodiments of the present disclosure may be applied to a wireless LAN system as well as other communication systems. For example, embodiments of the present disclosure may be implemented in wireless personal area network (WPAN), wireless body area network (WBAN), wireless broadband internet (WiBro), long range wide area network (LoRaWAN), or world interoperability for microwave access (WiMax), 2G mobile communication networks such as Global System for Mobile Communications (GSM) or Code Division Multiple Access (CDMA), 3G mobile communication networks such as wideband code division multiple access (WCDMA) or cdma2000, 3.5G mobile communication network such as a high speed downlink packet access (HSDPA) or a high speed uplink packet access (HSUPA), 4G mobile communication networks such as LTE (Long Term Evolution) or LTE-Advanced, and a 5G mobile communication network.

Figure 4:
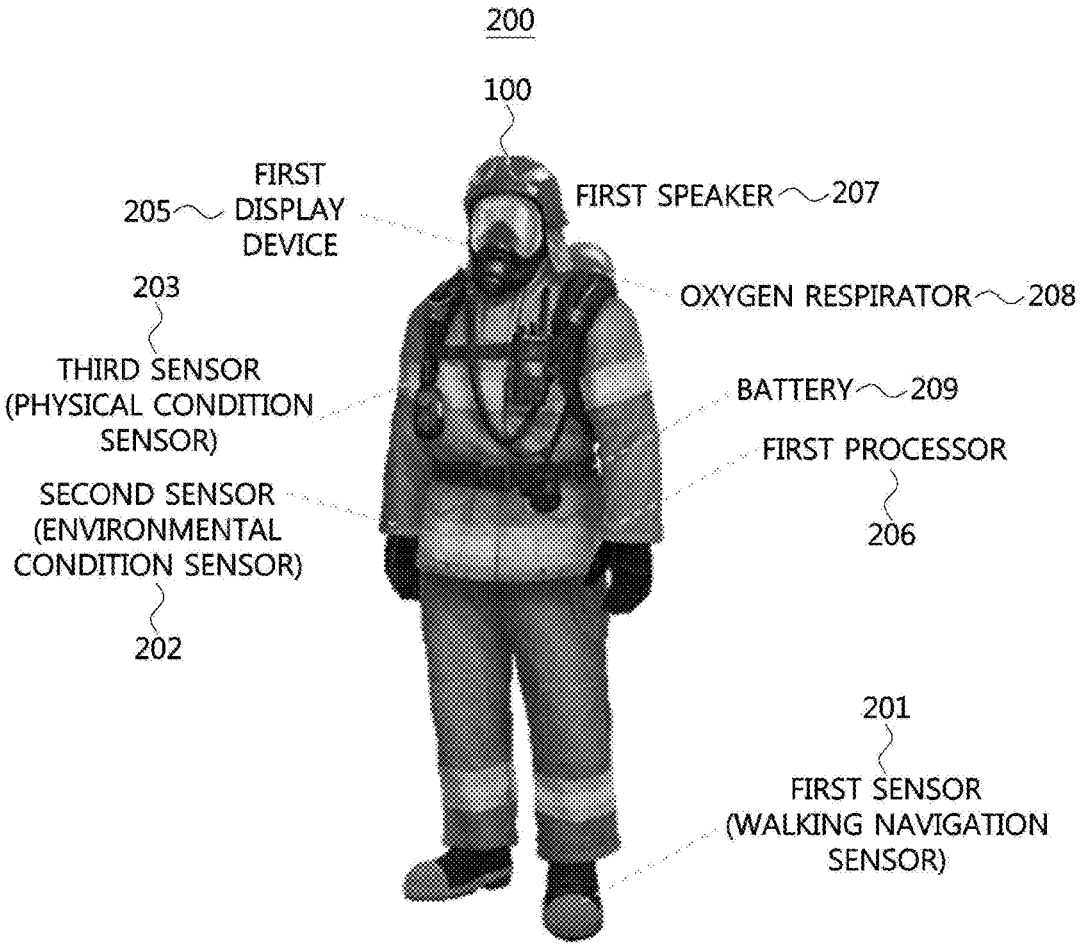
FIG. 4 is a conceptual diagram illustrating an embodiment of the first apparatus worn on a human body.

FIG. 4 is a conceptual diagram illustrating an embodiment of the first apparatus worn on a human body.

Referring to FIG. 4, the first user 100 may wear the first apparatus 200. The first sensor 201 included in the first apparatus 200 may be mounted on a boot of the first user 100. The first sensor 201 may be connected to the first processor 206. The first sensor 201 may identify the location of the first user 100 through a walking navigation technique. The first sensor 201 may transmit the location information of the first user 100 to the first processor 206. The first processor 206 may acquire movement path information of the first user 100 through the location information acquired from the first sensor 201.

The second sensor 202 included in the first apparatus 200 may be attached to various parts of the body of the first user 100. For example, the second sensor 202 may be attached to the front, rear, left, right, or helmet of the first user 100. The environmental condition information around the first user 100 may be obtained through the second sensor 202. For example, the second sensor 202 may measure a temperature around the first apparatus 200, a composition ratio of an air around the first apparatus 200 (e.g., carbon dioxide concentration, carbon monoxide concentration, sulfuric acid concentration, nitric oxide concentration, oxidant concentration, hydrocarbons concentration, fluoride concentration, ammonia (NH3) concentration, iridium concentration, etc.). The second sensor 202 may check whether an obstacle exists around the first apparatus 200 or the like. The first apparatus 200 may identify at least one of dangerous object, obstacle, and terrain at risk of collapse which is located at the front, rear, left, right, or upward of the first apparatus 200 via the second sensor 202 attached to the front, rear, left, right, or helmet of the first user 100. The second sensor 202 may be connected to the first processor 206 of the first apparatus 200. The second sensor 202 may transmit information on the ambient temperature around the first apparatus 200, the composition of the ambient air around the first apparatus 200, and the presence or absence of an obstacle around the first apparatus 200 to the first processor 206.

The third sensor 203 included in the first apparatus 200 may be attached to various parts of the body of the first user 100. For example, the third sensor 203 may be attached to the chest, back, waist, wrist, ankle, shoulder, knee, thigh, armpit, neck, etc. of the first user. The physical condition information of the first user 100 may be obtained through the third sensor 203. For example, the third sensor 203 may measure a heartbeat rate of the first user 100. Also, the third sensor 203 may measure the body temperature of the first user 100. The third sensor 203 may measure the concentration of carbon monoxide in the blood, the concentration of carbon dioxide in the blood, and the blood pressure of the first user 100. The third sensor 203 may identify whether the first user 100 is injured or bleeding. The third sensor 203 may be connected to the first processor 206 of the first apparatus 200. The third sensor 203 may transmit the identified physical condition information of the first user 100 to the first processor 206.

The first IoT device may be attached to an oxygen cylinder, a battery 209, an oxygen respirator 208, or the like. The first IoT device may transmit relevant information to the first processor 206 such as the oxygen cylinder, the battery 206, the oxygen respirator 208, and the like. The oxygen respirator 208 may be connected to the oxygen cylinder. The battery 209 may be attached to a portion of the body. In the embodiment of FIG. 4, the battery 209 is illustrated as attached to the back. The first IoT device may be connected to the first processor 206 included in the first apparatus 200. The first IoT device connected to the oxygen cylinder may transmit information such as the residual oxygen amount to the first processor 206. The first IoT device attached to the battery 209 may transmit a signal to the first processor 206, such as a remaining battery amount. The first IoT device attached to the oxygen respirator 208 may transmit information such as the number of breaths of the first user 100 to the first processor 206.

The first processor 206 may process the information received from the plurality of sensors 201, 202, and 203, the oxygen cylinder, the oxygen respirator 208, the battery 209, and the like. The information processed in the first processor 206 may be visually presented in the first display device 205 included in the first apparatus 200. Also, the information processed in the first processor 206 may be audibly presented in the first speaker 207 included in the first apparatus 200.

Figure 5:
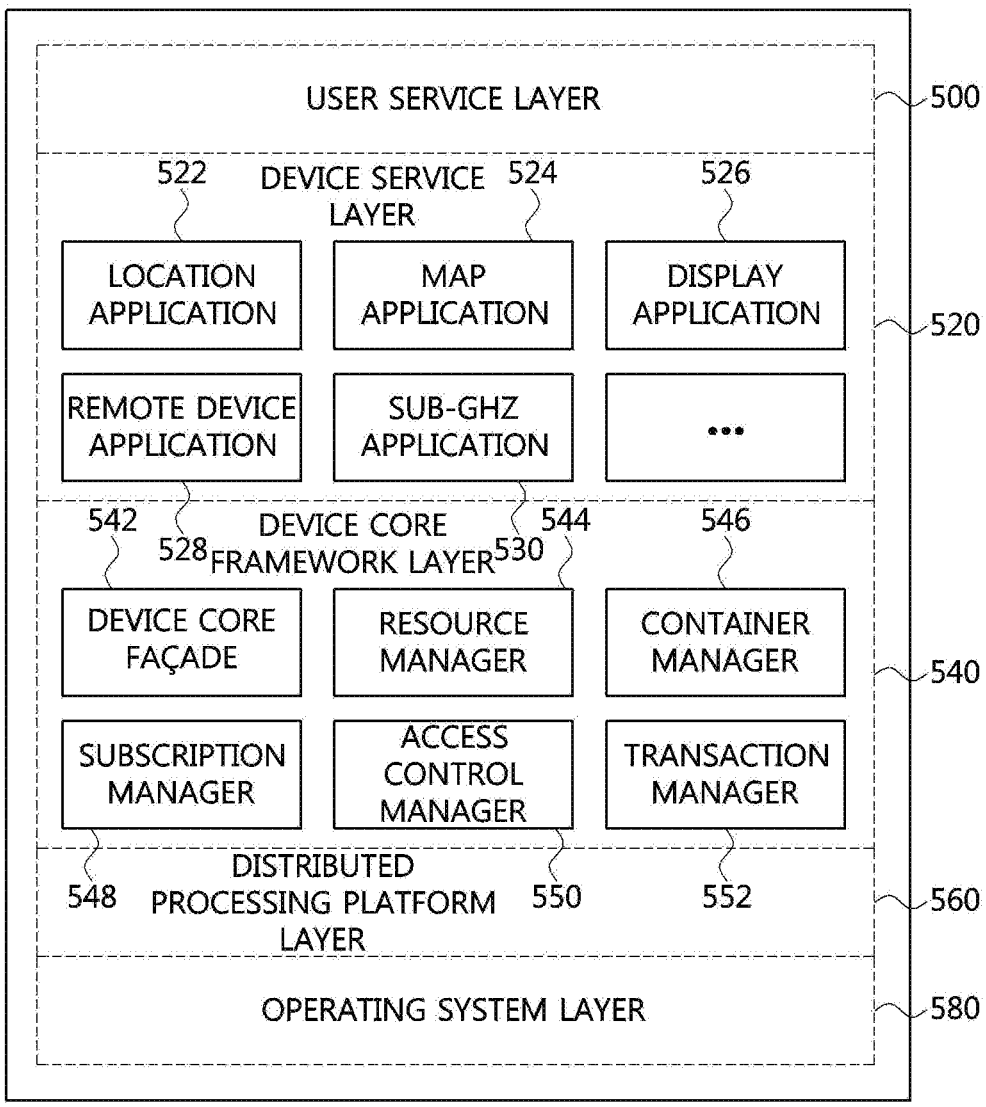
FIG. 5 is a block diagram illustrating software architecture of a first apparatus according to an embodiment of the present disclosure.

FIG. 5 is a block diagram illustrating software architecture of a first apparatus according to an embodiment of the present disclosure.

Referring to FIG. 5, the first apparatus may have software architecture for the first processor thereof comprising a user service layer 500, a device service layer 520, a device core framework layer 540, a distributed processing platform layer 560, and an operating system layer 580.

Respective layers may form a layered architecture. The operating system layer 580 may be located at the lowest layer and the distributed processing platform layer 560 may be located above the operating system layer 580 to handle distributed processing.

The device core framework layer 540 may be located above the distributed processing platform layer 560, and the device service layer 520 may be located above the device core framework layer 540. Also, the user service layer 500 may be located above the device service layer 520. The user service layer 500 may include a user-specific application implementing a function specific to the first user using the first apparatus.

The device service layer 520 may include a location application 522, a map application 524, a display application 526, a remote device application 528, a Sub-GHz application 530, and the like.

The location application 522 may manage information on the location of the first user received from the first sensor included in the first apparatus. The map application 524 may manage a map of the disaster area that the first processor has obtained from the server, and may provide the first user with an update of the map of the disaster area.

The display application 526 may visually provide the map of the disaster area to the first user. The remote device application 528 may enable information to be shared between the first user and other users through the transfer of information. The sub-GHz application 530 may support sub-GHz communications.

The device core framework layer 540 may provide, based on a RESTful architecture, a function of generating information to be stored in a memory included in the first apparatus, a function of retrieving the information, a function of updating the information, and a function of deleting the information. Also, the device core framework layer 540 may provide a function of checking access rights, and a function of send notifications when certain conditions are met. The specific configuration of the core framework layer 540 to provide these functionalities may be as follows.

The device core framework layer 540 may include a device core facade 542, a resource manager 544, a container manager 546, a subscription manager 548, an access control manager 550, a transaction manager 552, and the like.

The device core facade 542 may serve as a facade controller of the device core framework layer 540. Specifically, the device core facade 542 may provide interfaces with outside for creating information, retrieving information, updating information, and deleting information.

That is, upon receipt of a request of creating, retrieving, updating, or deleting information from outside, the device core facade 542 may transfer the request to relevant managers (e.g., the resource manager 544 and the container manager 546).

The resource manager 544 may manage application programs and devices mounted on the core framework. The container management 546 may create and manage a container capable of storing information.

The container manager 546 may be created by an application program and a device mounted on the core framework. In the container manager 546, contents instances may be stored.

The subscription manager 548 may send notifications to the corresponding application program and device when the specific application program and the device satisfy the criteria specified.

The access control manager 550 may manage access rights. For example, the access control manager 550 may confirm whether or not an authority exists when someone requests deletion of information to the core of the first apparatus. The transaction manager 552 may manage transactions for a database inside the core of the first apparatus.

In addition, the device core framework layer 540 may manage various application programs for supporting information gathering functions, information processing, augmented cognition, information visualization, notification, information transfer, and information sharing, which are main functions of the first apparatus.

Figure 6:
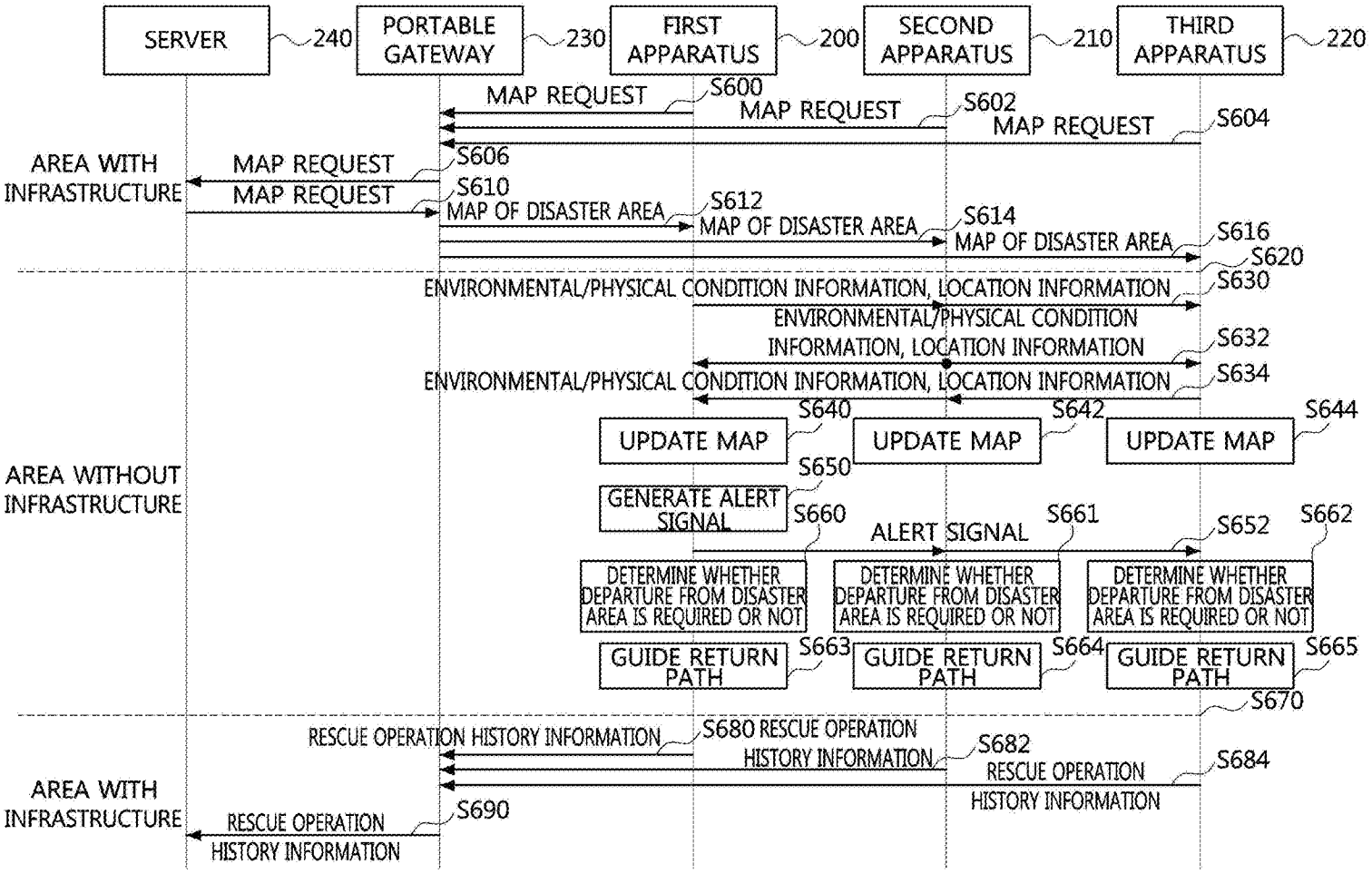
FIG. 6 is a flowchart for explaining a rescue operation according to an embodiment of the present disclosure.

FIG. 6 is a flowchart for explaining a rescue operation according to an embodiment of the present disclosure.

Referring to FIG. 6, S600 to S616 and S680 to S690 may represent an operation method of each node in an area having a communication infrastructure. Also, S630 to S665 may represent an operation method of each node in an area having no communication infrastructure.

The communication infrastructure may mean a control server, a network server, a gateway, a base station, an AP, and the like that support communications. The step S620 may mean a moment when the rescue apparatus (e.g., the apparatuses 200, 210, and 220) enters an environment without the communication infrastructure, and the step S670 may mean a moment when the rescue apparatus gets away from the environment without the communication infrastructure.

The server 240, the portable gateway 230, the first apparatus 200, the second apparatus 210, and the third apparatus 220 shown in FIG. 6 may respectively correspond to the server 240, the portable gateway 230, the first apparatus 200, the second apparatus 210, and the third apparatus 220 shown in FIG. 2.

The first apparatus 200 may transmit a signal requesting a map of a disaster area to the portable gateway 230 (S600). The second apparatus 210 may transmit a signal requesting the map of the disaster area to the portable gateway 230 (S602). Also, the third apparatus 220 may transmit a signal requesting the map of the disaster area to the portable gateway 230 (S604).

Then, the portable gateway 230 may transmit the signal requesting the map of the disaster area, which are received from the plurality of apparatuses 200, 210, and 220, to the server 240 (S606). The server 240 may receive the signal from the portable gateway 230.

The server 240 may transmit the requested map of the disaster area to the portable gateway 230, and the portable gateway 230 may receive the map of the disaster area from the server 240.

Then, the portable gateway 230 may transmit the map of the disaster area to the first apparatus 200 (S612). The portable gateway 230 may transmit the map of the disaster area to the second apparatus 210 (S614). The portable gateway 230 may transmit the map of the disaster area to the third apparatus 220 (S616).

The first user wearing the first apparatus 200, the second user wearing the second apparatus 210, and the third user wearing the third apparatus 220 may enter the disaster area (S620). In the disaster area, there may be no infrastructure required for communications.

The first processor included in the first apparatus 200 may transmit, in a broadcast manner, information on a location of the first apparatus 200 acquired from the first sensor 201, environmental condition information of the first apparatus 200 acquired from the second sensor 202, and physical condition information of the first user acquired from the third sensor 203 (S630).

The second processor included in the second apparatus 210 may transmit, in a broadcast manner, information on a location of the second apparatus 210 acquired from the fourth sensor 211, environmental condition information of the second apparatus 210 acquired from the fifth sensor 212, and physical condition information of the second user acquired from the sixth sensor 213 (S632).

The third processor included in the third apparatus 220 may transmit, in a broadcast manner, information on a location of the third apparatus 220 acquired from the seventh sensor 221, environmental condition information of the third apparatus 220 acquired from the eighth sensor 222, and physical condition information of the third user acquired from the ninth sensor 223 (S634).

The first processor included in the first apparatus 200 may determine a disaster risk level for each location in the disaster area based on the locations and environmental condition information of the plurality of apparatuses (e.g. the second to N-th apparatuses).

The environmental condition information gathered for the respective locations of the plurality of apparatuses 200, 210, and 220 may be classified according to a predetermined criterion, and disaster risk levels for the respective locations may be determined based on risk levels of the classified environment information corresponding to the respective locations.

For example, when the third sensor 203 of the first apparatus 200 of the first user senses an amount of carbon monoxide exceeding a predetermined criterion, the first processor included in the first apparatus 200 may determine the location where the carbon monoxide was sensed as a location with a disaster risk level of '1'.

Also, when the third sensor 203 included in the first apparatus 200 of the first user senses a temperature (e.g., 130° C.) exceeding a predetermined criterion, the first processor included in the first apparatus 200 may determine the location where the temperature of 130° C. is sensed as a location with a disaster risk level of '1'.

Also, when the sixth sensor 213 included in the second apparatus 210 of the second user senses a temperature (e.g., 85° C.) exceeding a predetermined criterion, the second processor included in the second apparatus 210 may determine the location where the temperature of 85° C. is sensed as a location with a disaster risk level of '2'.

The disaster risk level may have a plurality of levels. For example, a disaster risk level of '1' is the highest level corresponding to the most dangerous area, and a disaster risk level of '5' is the lowest level corresponding to the safest area. The disaster risk level may be determined by synthesizing not only the information of the first apparatus but also the information of the second to N-th apparatuses.

The plurality of apparatuses 200, 210 and 220 may update the map based on the disaster risk level and the information of the plurality of apparatuses 200, 210 and 220 (S640, S642 and S644). The information of the plurality of apparatuses 200, 210 and 220 may include information on locations, environmental condition information of the plurality of apparatuses 200, 210 and 220, physical condition information of the plurality of users 100, 102, and 104, residual battery amount, residual oxygen amount, and the like.

The first display device 205 included in the first apparatus 200 may visually display the map information updated in the first processor included in the first apparatus 200. The first speaker 207 included in the first apparatus 200 may audibly output the map information updated in the first processor.

When the environmental condition information sensed by the second sensor 202 included in the first apparatus 200 exceeds a predetermined criterion, the second sensor 202 may transmit an alert signal to the first processor included in the first apparatus 200 (S650).

When the alert signal is generated in the second sensor 202, the first processor included in the first apparatus 200 may receive the alert signal and transmit the alert signal to the plurality of other apparatuses 210 and 220 in a broadcast manner (S652).

Movement path information of the first apparatus 200 may be generated based on the location of the first apparatus 200, movement path information of the second apparatus 210 may generated based on the location of the second apparatus 210, and movement path information of the third apparatus 220 may be generated based on the location of the third apparatus 220.

The updated map information may include the locations, the movement path information, and the environmental condition information of the plurality of apparatuses 200, 210 and 220, the physical condition information of the plurality of users 100, 102 and 104, the disaster risk levels, and information on the alert signal.

In the map information, the disaster risk levels may be distinguished by color. For example, areas with a disaster risk level of 1 may be red-colored, areas with a disaster risk level of 2 may be orange-colored, areas with a disaster risk level of 3 may be yellow-colored, areas with a disaster risk level of 4 may be cyan-colored, and areas with a disaster risk level of 5 may be blue-colored.

The disaster risk level is an index indicating the degree of risk for each location in the disaster area, and is a risk index for each location of the entire disaster area generated based on the environmental condition information of the locations where at least one of the plurality of apparatuses 200, 210, and 220 was once located.

The physical condition information may include the corresponding user's heart rate, body temperature, blood noxious gas concentration (e.g., blood carbon monoxide concentration, blood carbon dioxide concentration), blood pressure, whether the corresponding user is injured or bleeding, and the like.

The environmental condition information may include ambient temperature around the apparatus, composition of ambient air, and presence of obstacles nearby (e.g., dangerous objects, obstacles, and terrain at risk of collapsing that exist at the front, rear, left, right or upward of the apparatus.

The plurality of apparatuses 200, 210, and 220 may examine whether or not a return is required (S660, S661, and S662). The return may be required when the rescue is complete, when the rescue is no longer possible, or when an inevitable circumstance in which the rescue cannot be sustained occurs.

The inevitable circumstance in which the rescue can no longer be sustained may include a case where the temperature of the disaster area exceeds a predetermined threshold, a case where the risk of collapse of the disaster area is high, a case where a hazardous gas component of the disaster area exceeds a predetermined reference, and the like.

The plurality of apparatuses 200, 210 and 220 may be respectively guided to an optimal return path from where the plurality of apparatuses 200, 210 and 220 are located (S663, S664, and S665).

A method for calculating the optimal return path of the plurality of users 100, 102, and 104 may be as follows. The first processor included in the first apparatus 200 may calculate a plurality of paths from, a current location to an exit for each of the plurality of users 100, 102, and 104.

The first processor included in the first apparatus 200 may exclude paths passing through locations having a disaster risk level greater than or equal to a predetermined threshold among the computed paths. The optimal return path may be determined as a path having the shortest distance among the plurality of paths excluding the paths through locations having the disaster risk level greater than or equal to the predetermined threshold. A method for determining an optimum return path may be described with reference to FIG. 1.

Referring to FIG. 1, the first user 100, the second user 102, and the third user 104 who are dispatched to the disaster area, and the fourth user 106 who is not yet dispatched to the disaster area may be identified. Also, environmental condition information, physical condition information, and location information of the plurality of users 100, 102, and 104 may be obtained as shown in blocks 110, 112, and 114.

In the disaster area, return paths 120, 121, 122, 123, 124, and 126 of the plurality of users 100, 102, and 104 may be identified. In the disaster area, blocks 130, 132, and 134 may be places temperatures of which are be identified, and an obstacle 140 may be identified.

A first flame 150, a second flame 152 and a first flame 154 may be identified in the disaster area, and a first exit 160, a second exit 162, and a third exit 164 may be identified. Also, it may be confirmed that the temperature near the flames are measured higher than the temperature of others.

Referring to the first user 100, the first processor included in the first apparatus 200 may identify the ambient gas concentration around the first user 100. Then, the first processor may determine the return if the ambient gas concentration exceeds a predetermined reference value.

The ambient gas concentration described in FIG. 1 may indicate the concentration of carbon monoxide as an example. The first processor included in the first apparatus 200 may identify a path 120 from the current location of the first user 100 to the first exit 160, a path 121 from that to the second exit 162, and paths 122 and 123 from that to the exit 164.

Also, the first processor may identify a path including a location having a disaster risk level equal to or greater than a predetermined threshold (e.g., a path including a location whose disaster risk level is '1' or '2') among the plurality of identified paths 120, 121, 122, and 123.

The path 120 to the first exit 160 may be a path that can be selected because there is no disaster risk factor. For example, the path 121 to the first exit 160 may have locations having low disaster risk levels (e.g., '4' or '5').

The path 121 to the second exist 162 may be difficult to return to the second exit 162 due to the obstacle 140. Also, the path 121 to the second exit 162 has the first flame 150 and may be at a higher temperature (e.g., 60° C.) than other areas. Thus, the path 121 to the second exit 162 may include a location having a disaster risk level '1' or '2'.

The path 122 to the third exit 164 may be possible to return because there is no disaster risk factor. For example, the path 122 to the third outlet 164 may have locations having low disaster risk levels (e.g., '4' or '5').

The path 123 to the third exit 164 has the second flame 152 in the path and may be at a higher temperature than the other (e.g., 70° C.). Therefore, the path 123 to the third exit 164 may include a location having a disaster risk level '1' or '2'.

The first apparatus 200 may determine the path 120 having the shortest distance as the optimal return path among the plurality of return paths 120 and 122 that do not include locations having a disaster risk level '1' or '2'. The second apparatus 210 and the third apparatus 220 may determine the optimal return path in the same manner as the first apparatus 200.

The optimal return path determined in the first apparatus 200 may be visually represented in the first display device 205 included in the first apparatus 200. Also, the optimal return path determined by the first device 200 may be provided audibly in the first speaker 207 included in the first apparatus 200.

The plurality of apparatuses 200, 210, and 220 may transmit rescue operation history information to the portable gateway 230 when they are out of the disaster area (S680, S682, and S684). The portable gateway 230 may receive the rescue operation history information from the plurality of apparatuses 200, 210, and 220.

The rescue operation history information may include movement path information, environmental condition information for respective locations in the disaster area, and physical condition information at the respective locations in the disaster area of the plurality of apparatuses 200, 210 and 220.

The portable gateway 230 may transmit the rescue operation history information received from the plurality of apparatuses 200, 210, and 220 to the server 240. The server 240 may receive the rescue operation history information from the portable gateway 230.

The embodiments of the present disclosure may be implemented as program instructions executable by a variety of computers and recorded on a computer readable medium. The computer readable medium may include a program instruction, a data file, a data structure, or a combination thereof. The program instructions recorded on the computer readable medium may be designed and configured specifically for the present disclosure or can be publicly known and available to those who are skilled in the field of computer software.

Examples of the computer readable medium may include a hardware device such as ROM, RAM, and flash memory, which are specifically configured to store and execute the program instructions. Examples of the program instructions include machine codes made by, for example, a compiler, as well as high-level language codes executable by a computer, using an interpreter. The above exemplary hardware device can be configured to operate as at least one software module in order to perform the embodiments of the present disclosure, and vice versa.

While the embodiments of the present disclosure and their advantages have been described in detail, it should be understood that various changes, substitutions and alterations may be made herein without departing from the scope of the present disclosure.

What is claimed is:

1. An operation method of a first apparatus carried by a first user for supporting disaster communications, the operation method being performed by the first apparatus and comprising:

obtaining map information of a disaster area from a server when the first apparatus is located outside the disaster area;

when the first apparatus is located within the disaster area, obtaining location information of the first apparatus through a first sensor included in the first apparatus and obtaining environmental condition information of the first apparatus indicating a risk of an area to which the first apparatus belongs through a second sensor included in the first apparatus;

obtaining, from a second apparatus carried by a second user which is located within the disaster area, location information and environmental condition information of the second apparatus;

determining disaster risk levels for each location in the disaster area based on the location and environmental condition information of the first apparatus and the location and environmental condition information of the second apparatus; and updating the map information by reflecting the disaster risk levels.

2. The operation method according to claim 1, wherein the determining disaster risk levels comprises:

classifying environmental condition information for the respective locations of the first apparatus and the second apparatus according to a predetermined criterion; and determining the disaster risk levels for the respective locations corresponding to the classified environmental condition information for the respective locations of the first apparatus and the second apparatus.

3. The operation method according, to claim 1, farther comprising:

determining whether a current situation is a situation requiring departure from the disaster area;

in response to determination that the current situation is the situation requiring departure from the disaster area, classifying at least one location whose disaster risk level is higher than a predetermined threshold based on the map information reflecting the disaster risk levels;

identifying an optimal return path avoiding the at least one location whose disaster risk level is higher than the predetermined threshold based on the location information of the first apparatus; and displaying the optimal return path on a display device included in the first apparatus.

4. The operation method according to claim 1, further comprising, when the first apparatus is out of the disaster area, transmitting rescue operation history information to the server, wherein the rescue operation history information includes:

movement path information of the first apparatus in the disaster area, and the environmental condition information for each location of the first apparatus in the disaster area, and movement path information of the second apparatus in the disaster area, and the environmental condition information for each location of the second apparatus in the disaster area.

5. The operation method according to claim 4, wherein; the movement path information of the first apparatus is generated based on the location information of the first apparatus, and the movement path information of the second apparatus is generated based on the location information of the second apparatus.

6. The operation method according to claim 1, further comprising:

updating the map information to indicate locations of users of the first and second apparatuses through the location information of the first apparatus and the location information of the second apparatus; and displaying the updated map information on a display device included in the first apparatus.

7. The operation method according to claim 1, wherein:

the environmental condition information of the first apparatus includes ambient temperature, composition of ambient air, and presence or absence of an obstacle at the location of the first apparatus, and the environmental condition information of the second apparatus includes ambient, temperature, composition of ambient air, and presence or absence of an obstacle at the location of the second apparatus.

8. The operation method according to claim 1, further comprising:

obtaining first physical condition information of a first user of the first apparatus through a third sensor included in the first apparatus;

obtaining second physical condition information of a second user of the second apparatus from the second apparatus; and displaying the first physical condition information and the second physical condition information on a display device included in the first apparatus.

9. The operation method according to claim 1, further comprising:

generating an alert signal for the first apparatus when the environmental condition information of the first apparatus exceeds a predetermined reference value; and transmitting the alert signal in a broadcast manner.

10. A first apparatus carried by a first user for supporting disaster communications, comprising a processor and a memory storing at least one instruction executed by the processor, wherein the at least one instruction is configured to:

obtain, map information of a disaster area from a server when the first apparatus is located outside the disaster area;

when the first apparatus is located within the disaster area, obtain location information of the first apparatus through a first sensor included in the first apparatus and obtain environmental condition information of the first apparatus indicating a risk of an area to which the first apparatus belongs through a second sensor included in the first apparatus;

obtain, from a second apparatus carried by a second user which is located within the disaster area, location information and environmental condition information of the second apparatus;

determine disaster risk levels for each location in the disaster area based on the location and environmental condition information of the first apparatus and the location and environmental condition information of the second apparatus; and update the map information by reflecting the disaster risk levels, wherein, in the determining of the disaster risk levels, the at least one instruction is further configured to:

classify environmental condition information for the respective locations of the first apparatus and the second apparatus according to a predetermined criterion; and determine the disaster risk levels for the respective locations corresponding to the classified environmental condition information for the respective locations of the first apparatus and the second apparatus.

11. The first apparatus according to claim 10, wherein the at least one instruction is further configured to:

determine whether a current situation is a situation requiring departure from the disaster area;

in response to determination that the current situation is the situation requiring departure from the disaster area, classify at least one location whose disaster risk level is higher than a predetermined threshold based on the map information reflecting the disaster risk levels;

identify an optimal return path avoiding the at least one location whose disaster risk level is higher than the predetermined threshold based on the location information of the first apparatus; and display the optimal return path on a display device included in the first apparatus.

12. The first apparatus according to claim 10, wherein the at least one instruction is further configured to, when the first apparatus is out, of the disaster area, transmit, rescue operation history information to the server, wherein the rescue operation history information includes:

movement path information of the first apparatus in the disaster area, and the environmental condition information for each location of the first apparatus in the disaster area, and movement path information of the second apparatus in the disaster area, and the environmental condition information for each location of the second apparatus in the disaster area.

13. The first apparatus according to claim 12, wherein:

the movement path information of the first apparatus is generated based on the location information of the first apparatus, and the movement path information of the second apparatus is generated based on the location information of the second apparatus.

14. The first apparatus according to claim 10, wherein the at least one instruction is further configured to:

update the map information to indicate locations of users of the first and second apparatuses through the location information of the first apparatus and the location information of the second apparatus, and display the updated map information on a display device included in the first apparatus.

15. The first apparatus according to claim 10, wherein;

the environmental condition information of the first apparatus includes ambient temperature, composition of, ambient air, and presence or absence of an obstacle at the location of the first apparatus, and the environmental condition information of the second apparatus includes ambient temperature, composition of ambient air, and presence or absence of an obstacle at the location of the second apparatus.

16. The first apparatus according to claim 10, wherein the at least one instruction is further configured to:

obtain first physical condition information of a first user of the first apparatus through a third sensor included in the first apparatus;

obtain second physical condition information of a second user of the second apparatus from the second apparatus; and display the first physical condition information and the second physical condition information on a display device included in the first apparatus.

17. The first apparatus according to claim 10, wherein the at least one instruction is further configured to:

generate an alert signal for the first apparatus when the environmental condition information of the first apparatus exceeds a predetermined reference value; and transmit the alert signal in a broadcast manner.

* * * * *